United States Patent [19]

Sharp

[11] Patent Number: 4,622,878

[45] Date of Patent: Nov. 18, 1986

[54] STEREOPHONIC SYSTEM FOR ELECTRONIC ORGANS

[75] Inventor: Paul H. Sharp, Fullerton, Calif.

[73] Assignee: CBS Inc., New York, N.Y.

[21] Appl. No.: 724,441

[22] Filed: Apr. 18, 1985

[51] Int. Cl.[4] ..... G10H 1/02; G10H 7/00; H04R 5/00

[52] U.S. Cl. ..... 84/1.24; 84/DIG. 1; 84/DIG. 27; 381/1; 381/118

[58] Field of Search ..... 84/1.09, 1.24, 1.25, 84/1.27, DIG. 1, DIG. 4, DIG. 27; 381/1, 24, 118

[56] References Cited

U.S. PATENT DOCUMENTS 2,114,019 4/1938 Friebus ..... 84/DIG. 27 X
2,821,878 2/1958 Stibitz ..... 84/DIG. 27 X
3,136,853 6/1964 Bissonette et al. ..... 84/DIG. 1 X
3,160,695 12/1964 Bonham ..... 84/DIG. 27 X

*Primary Examiner*—William B. Perkey
*Attorney, Agent, or Firm*—Spencer E. Olson

[57] ABSTRACT

A stereophonic electronic organ system having two electrical-acoustic channels each including a loudspeaker separated from the other, note generating means for producing for each note in a musical range two time-displaced electrical signals of substantially the same frequency corresponding to the note, and means for coupling one of the two signals for each note to one of the channels and means for coupling the other of the two signals to the other of the two channels. The two time-displaced signals for each note may be produced by providing two digital tone generators for each note and time-displacing one note from the other.

9 Claims, 4 Drawing Figures

STEREOPHONIC SYSTEM FOR ELECTRONIC ORGANS

BACKGROUND OF THE INVENTION

This invention relates to electronic musical instruments and, more particularly, to an electronic organ system for producing a stereophonic sound image.

A stereophonic recording of a real pipe organ sounds very realistic and pleasing, but an electronic organ locks this realism both when listened to directly or when listening to a recording of its performance. As is pointed out in U.S. Pat. Nos. 2,596,258 and 3,049,040 of Donald J. Leslie, much of this lack of realism is caused by electrically mixing the outputs of the organ's oscillators or tone generators into one channel, whereas pipe organs contain many separate sound sources which are combined differently in the two ears of the listener. The lack of realism is particularly apparent when two notes which contain frequencies very close to each other are played simultaneously; for example, celeste notes which are purposely tuned a few cycles sharp, octaves which are slightly out of tune with each other, in which case harmonics of the upper note will beat with the even harmonics of the notes which are an octave lower, and notes that are a fourth or a fifth musical interval apart and contain harmonics which because of the tempered scale are slightly out of tune with each other and produce beats. Thus, if, with the string stop on, only the keys middle C and G above it are depressed, fifth interval beating would occur. If the 4′ coupler is then turned on, the following beats would occur: C with G, C with C4′, C with G4′, G with C4′ (a fourth interval beat), G with G4′, and C4′ with G4′. If a string celeste is added, it is seen that there will be twenty-eight separate beat combinations of the eight notes that would be sounding. In a pipe organ this produces a beautiful ensemble effect because each of the twenty-eight combinations produces a different effect on each of the listener's two ears. In order to duplicate this ensemble effect in an electronic organ, eight separate audio channels and speakers would be required, the cost of which normally would be prohibitive and the provision of which would be difficult in a home consumer-type electronic organ. On the other hand, if these eight notes are mixed into one audio channel and speaker system, a single amplitude modulated signal is radiated into the room and all the beats would be presented to both ears of the listener in the same way, with no differential effects, thereby depriving the listener of any spatial information.

For a better understanding of this phenomenon, consider two equal amplitude sinewaves, one having a frequency of 500 Hz and the other a frequency of 502 Hz. If these signals are electrically mixed, amplified and reproduced through a loudspeaker, a beat frequency that is alternately loud and soft two times per second will be heard; in a dead room the beat signal would be loud to both ears of a listener at the same time and soft to both onefourth second later. In order for a listener to perceive spatial information, it is necessary that the signal at one ear be increasing in loudness at the same time it is decreasing or staying constant at the other ear, and vice versa. This can be accomplished in a number of ways with varying degrees of effectiveness. In the simplest case, if the speaker in the above example is placed in a very "live" room having a reverberation decay time of approximately one second, and sound is radiated into the room from the speaker, standing waves are set up.

In the case of a single sound source, standing waves result from the total reflected sound being of such phase and amplitude as to reinforce the direct sound or to reduce, or in some cases, cancel it. This means that a steady state tone will have a wide range of loudness levels throughout the room and in some places it will cancel out completely. The distance between these peaks and valleys will be determined by the frequency and thus the wave length of the sound signal. If we humans did not have two ears spaced apart, this would present real listening problems; however, being spaced apart, one ear can be positioned at a null while the other is located at a point of fairly high intensity, thus greatly reducing the apparent loudness variations one perceives as one moves about the listening room. At low frequencies the ears are too close together relative to the wave length of the sound signal and standing waves do sometimes give real listening problems. If now the intensity of the sound source in a reverberent room is changed fairly rapidly, the standing waves will all change their positions and continue to change their positions until the room sound level has stabilized at the new sound level of the source. This effect is more apparent when the loudness variations are caused by a beat between two frequencies than variations caused by simple amplitude modulation of a single frequency; this is so because a beat note is equivalent to a frequency half way between the two beating frequencies being combined in a balanced modulator with the frequency difference between them (i.e., the 501 Hz modulated by 2 Hz). Since a balanced modulator alternately reverses the phase of the modulated signal, the 501 Hz signal would build up in loudness, then go to zero and start building up 180° out of phase with its prior value, then back to zero again followed by buildup to again be in phase with the original value. This phase reversal will cause the standing waves to momentarily change places with each other, because in those places where the direct sound was reinforcing the reflected sound it will for a short time cancel or reduce the level, and in those places where the direct sound was cancelling the reflected sound, it will now reinforce it. Thus, it will be seen that a continually changing loudness creates a dynamic situation which, in a live room, changes the standing waves, which is perceived as a spatial effect because it will not be identical at both ears of the listener at the same time. The effect is otherwise in a dead room because there will be no sound in the room to react one-half second later with the direct sound.

Consider now the case where there are two separate sound sources; for example, a 500 Hz sound signal radiated by one speaker and a 502 Hz sound signal radiated by a second speaker. At some point in time the cones of the two loudspeakers will be moving in phase with each other, and if it is assumed that the speakers are in a free space with no reflected sound, the sound in the area equidistant from the two speakers will be reinforced. If now the listener moves to one side so that one speaker is about one foot further from the listener than the other one, a certain amount of cancellation will occur because the wave length of a 500 Hz sinewave is a little over two feet; thus, in traveling one foot the phase will be reversed. Accordingly, interference patterns will be set up, even in free space. In a dead room with reflections there will again be standing waves, but the standing waves will be different for each speaker because of their different locations in the room and the fact that sound coming from both speakers contributes to a standing wave pattern in the room. Because of the frequency difference of the sound signals, a little time later the cones of the two loudspeakers will be moving in opposite directions, causing all the standing waves to move and create a dynamic effect. In this case, however, the effect does not depend on reverberation and a pleasant spatial effect can be perceived even in a dead room.

A similar result is achieved by the system disclosed in the aforementioned Leslie U.S. Pat. No. 3,049,040, wherein one of a set of tone generators is coupled to both channels of a pair in one fixed relative phase relationship and another generator of the set is coupled to both channels in a second different relative fixed phase relationship, each channel having a separate transducer physically separated from the other. If, for example, 500 Hz and 502 Hz signals are electrically combined in one of the channels, and the phase of the 502 Hz signal is reversed and electrically combined with the 500 Hz signal in the second channel, when the signals are in phase they will reinforce each other in one channel and will cancel each other in the other channel, and vice versa. This causes a dynamically changing standing wave pattern in the room which sounds approximately the same as the two-source arrangement discussed previously, but has the important advantage that it is not necessary to combine the signals 180° out of phase for the system to work; for example, a phase shift of 90° works quite satisfactorily. This makes it possible to combine the aforementioned eight channels in different phase relationships into two channels without destroying the spatial effects, and obtaining a result equivalent to what happens when a stereophonic recording is made. In stereophonic recording, because of the different distances the microphones are from each separate sound source, the phases of each of the signals as they arrive at the two microphones will be different and statistically most of the spatial information will be preserved. Although the apparatus disclosed in U.S. Pat. No. 3,049,040 theoretically is capable of generating a stereophonic effect, as a practical matter it is difficult and extremely costly, particularly in analog organ designs, to provide separate phase shift circuits for each signal for coupling them into two separate sound channels.

Another departure from realism caused by electrical combination of the outputs of two or more oscillators or tone generators of an electric organ is that the buildup of acoustic energy at the ears of the listener when a single note at different stops are sounded does not correspond to what happens in the real world and therefore lacks the pleasing effect of a pipe organ where sounds from two or more sources are acoustically combined. More specifically, when two electrical sound-representing signals each having an amplitude of one volt, for example, are electrically combined, the resultant signal has an amplitude of two volts and, since the acoustic power developed by a loudspeaker is proportional to the square of the voltage, the resulting acoustic power goes up by a factor of four, whereas if the two signals were reproduced separately and acoustically combined, the energy would only be doubled. These fundamental laws create severe problems in electronic organ design, such as the need to leave adequate amplifier head room to accommodate the signals. The problem was recognized by the developers of the digital organ described in U.S. Pat. No. 4,202,234, and was solved by performing, in the waveform compiler, the square root of the sum of the squares of the amplitudes of all harmonics; accordingly, instead of the addition of two equal amplitude signals resulting in a doubling of amplitude, they are added according to a square law function.

The primary object of this invention is to provide a simple arrangement of tone generators, electrical circuits and electrical-acoustic channels for generating a stereophonic sound image.

Another object of this invention is to provide apparatus for minimizing beat effects which, at the same time generates a stereophonic sound image.

Yet another object of this invention is to improve the realism of an electronic organ.

SUMMARY OF THE INVENTION

Briefly, the apparatus according to the invention has two electrical-acoustic channels, each having a separate loudspeaker separated from the other, means for producing for each note in a musical range two electrical signals of the same waveform and frequency corresponding to the note and which are time-displaced from each other, means coupling one of the two signals for each note to one of the signal channels and means coupling the other of the two signals for each note to the other of the two signal channels. The two time-displaced signals for each note are readily obtained in electronic organs utilizing digital tone generation by providing two tone generators for each note and time-displacing one note from the other, either by a fixed amount selected to optimize the spatial effect or by an amount that changes slightly with time and/or each time the note key is depressed.

BRIEF DESCRIPTION OF THE DRAWINGS

Other objects, features and advantages of the invention, and a better understanding of its construction and operation, will be had from the following detailed description, taken in conjunction with the accompanying drawings, in which.

DESCRIPTION OF THE PREFERRED EMBODIMENT

Figure 1:
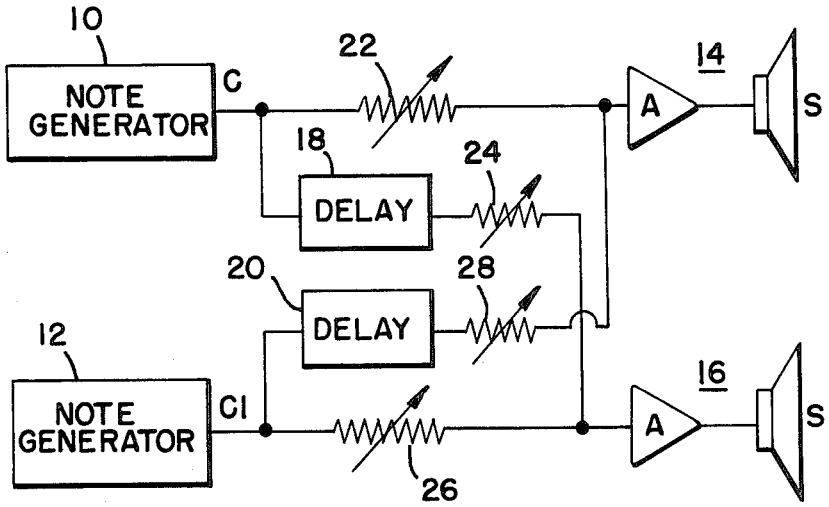
FIG. 1 is a simplified block diagram of a system incorporating the present invention.

Referring to FIG. 1, there is illustrated note generators 10 and 12 for only two notes of an electronic organ; in this instance, notes C and the octave higher note C1, it being understood that they are operated by respective keys of a keyboard (not shown). The system includes two identical electrical-acoustic channels 14 and 16, each including an amplifier A and a loudspeaker S. Note generator 10, and note generators for the tones comprising alternate octaves 2, 4, 6, etc., connect to channel 14, and signals of the same frequency and waveform, but displaced in time by suitable delay means 18 are applied to the second channel 16. Similarly, note generator 12, and note generating circuits for octaves 1, 3, 5, etc. are connected to channel 16, and signals corresponding in frequency and waveform, but time displaced by a suitable delay means 20, are applied to the other electrical-acoustic channel 14. Delay circuits 18 and 20 may each have a fixed delay having a value such as to avoid having signals emanating from the two speakers being in opposition to each other, which would cause undesirable cancellation. Preferably, the delay is chosen so that all signals applied to the two channels are within a phase range of −90° to +90° with respect to each other to insure against cancellation. With these constraints, the signals from the two speakers would always be additive in that they would either be in phase or displaced one way or the other by 90° from an in-phase condition. Alternatively, the amount of delay may be randomly selected by suitable means, such as a noise generator or pseudorandom number generator, each time the key is depressed; while in this case there is a remote possibility that the sound of a given note emanating from the two loudspeakers will be 180° out of phase and thus would be reduced in loudness, the number of times this is likely to occur is so small as not to be perceived. The essence of the invention is that when a given note is played the tone signal for that note is applied to both of two channels time-displaced from each other, with the time displacement differing from note to note, thus creating a sound image which causes the instrument to sound stereophonic.

Chorus generating systems which use broadband phase-shift networks can cause the fundamental and all the hormonics of an applied harmonically-rich tone signal to all cancel at the same time. In other words, the fundamental, the second harmonic, the third harmonic, etc., all will come to zero at the same time and the tone may go away completely. However, if the signal to one channel is time displaced with respect to the same signal applied to the other channel, then all the harmonics will come to zero at different times; that is, when the fundamental emanating from one loudspeaker may be cancelling the fundamental emanating from the other loudspeaker, the second, third, fourth, etc., harmonics are still producing sound because of the phase incoherence imparted by the time shift.

With the availability of two signals per note, it is possible to control the amplitudes of the two tone signals independently of each other, a very small reduction in the amplitude of one with respect to the other creating the perception that the sound is coming from the direction of the louder of the two. As is diagramatically shown in FIG. 1, the amplitude of the undelayed tone signal from generator 10 may be controlled by an attenuator 22, independently of control by an attenuator 24 of the delayed tone signal from generator 10. Similarly, the undelayed and delayed note signal from generator 12 may be separately controlled by attenuators 26 and 28, respectively. The difference in amplitude of the two note signals should not be so great as to frustrate beat cancellation, but a certain amount of difference in amplitude together with the different time relationships in the two channels together simulates what happens when a performance is recorded stereophonically in a closed listening room.

Figure 2:
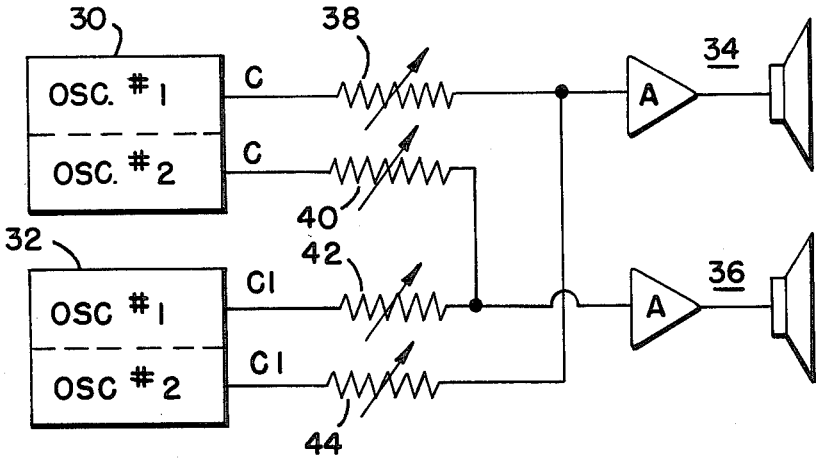
FIG. 2 is a block diagram of a more specific embodiment of the invention.

Referring now to FIG. 2, there is shown a readily realizable embodiment of the principles described in connection with FIG. 1 which obviates the requirement for discrete delay devices for displacing in time the note signal corresponding to a given key applied to one of two channels relative to the same note signal applied to the other channel. This is accomplished by providing for each key two note generators for generating two note signals of substantially the same frequency and waveform but time-displaced from each other. As in the case of FIG. 1, generators for only two octavely-separated notes are shown, a generator 30 comprising two oscillators each of which generates an electrical signal having a frequency substantially corresponding to middle C, and a generator 32 also comprising two oscillators each producing a signal having a frequency corresponding to note C1 an octave higher. In both generators the signal generated by one of the oscillators is time-displaced in random fashion from the signal delivered by the other oscillator; that is, the signal from oscillator #1 may at times "lead" the signal from oscillator #2, and by a varying amount from one key depression to the next, and at other times the signal from oscillator #2 may "lead" the signal delivered by oscillator 1. The same is true for the two tone signals from generator 32 corresponding to note C1.

Paired tone signals having the described properties are obtainable from a known form of digital tone generator in a manner to be described presently. Important to the creation of the stereophonic image is the fact that the time relationship between the two note signals from generator 30 is different from the time relationship between the two signals from generator 32. Because of the described randomness, either of the two signals can be applied to either of two electricalacoustic channels 34 and 36, but in the illustrated case the output from oscillator #1 of generator 30 is coupled via an adjustable attenuator 38 to channel 34 and the signal generated by oscillator #2 of generator 30 is coupled via an independent variable attenuator 40 to the other channel 36. Similarly, oscillator #1 of generator 32 is connected via an attenuator 42 to channel 36 and the other oscillator is coupled via attenuator 44 to channel 34. As in the FIG. 1 system, the attenuators are provided for independently adjusting the amplitude of each of the tone signals.

Figure 3:
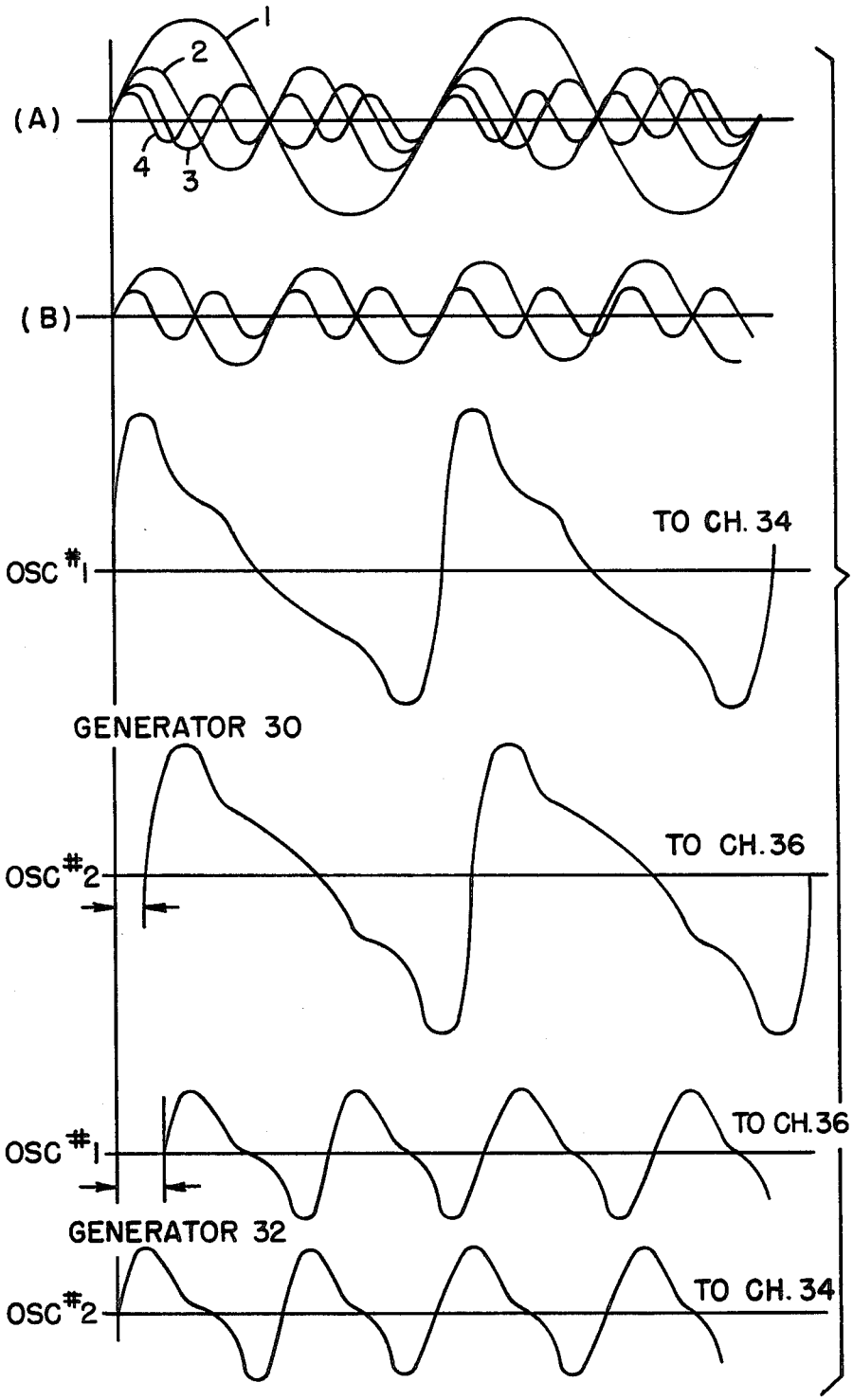
FIG. 3 is a series of waveforms useful in explaining the operation of the system shown in FIG. 2.

The significance of time-displacing two like signals and applying one to a first reproduction channel and the other to a second reproduction channel will be seen from the waveforms shown in FIG. 3 wherein the sawtooth-like waveforms labeled "generator 30" approximate the combination of the fundamental and harmonics of the signal shown in waveform (A), and the sawtooth-like waveforms labeled "generator 32" represent the combination of the sinewave signals shown in waveform (B). Waveform (A) is shown as comprising a fundamental wave of a given frequency, which may correspond to middle C, and the second, third and fourth harmonics of the fundamental. Wavefore (B) represents a signal having a frequency an octave higher than that of waveform (A) and for clarity includes only the fundamental and second harmonic. It will be noted that the fourth hormonic of waveform (A) is in phase with the second harmonic of waveform (B) and that the second harmonic of waveform (A) is in phase with the fundamental of waveform (B) and, accordingly, when the two complex tone signals are combined they will produce beats, and in organs in which the tone generators are phase-locked there will be times when harmonics of the two tone signals will simultaneously cancel each other if they are of equal amplitude or are all being reduced in amplitude at the same time. There will, of course, be times when a higher order beat will beat more often than a lower order one, so there will be time when it goes to zero when the second harmonic doesn't go to zero, but nevertheless there is a time when the fundamental, second harmonic, third harmonic and fourth harmonic of the note represented by waveform (A) will all cancel at the same time and produce an undesirable beat.

In accordance with the present invention, the signals represented by waveforms (A) and (B) are displaced in time relative to each other, the delay in the embodiment to be described being random in amount and direction. However, by way of explanation, if the waveform (B) signal were delayed by an amount equal to a quarter of a cycle of the second harmonic, then this harmonic will be 90° out of phase with respect to the fourth harmonic of waveform (A) and, similarly, the fundamental of waveform (B) will be displaced by a lesser amount from the second harmonic of waveform (A), thus insuring that all harmonics will not cancel at the same time. Because of the time displacement, the beating is random and sounds better becasue even though at any instant a given harmonic is emanating from both loudspeakers in the same phase relationship and therefore causing cancellation, there would be other harmonics in the two notes for which cancellation would not be occurring. It turns out statistically that a pleasant chorus effect is produced substantially all of the time, throughout the keyboard, with little likelihood that a note can be sounded that will not produce a pleasant chorus.

As has been noted, the generally sawtoothshaped waveforms from generator 30 are representative of the complex note signal shown in waveform (A), with one time-displaced from the other, and the sawtooth-shaped signals from generator 32 correspond to the complex signal shown in waveform (B) and are time-displaced relative to each other and to the two signals from generator 30. The output from oscillator #1 of generator 30 and the output of oscillator #2 of generator 32 are applied to reproducing channel 34 (FIG. 2) and the output of oscillator #2 of generator 30 and the output of oscillator #1 of generator 32 are applied to the second sound reproducing channel 36. By virtue of the different time relationships of the four signals, the signals in channel 34 will combine and produce beats at certain times and the two signals in channel 36 will combine and produce beats which will occur at different times; each harmonic will have its own time-related point at which the output is minimal, and then sometime later will produce an output that is maximum each harmonic having a different beat rate with the times of occurrence for those beats at the two loudspeakers being different. That is, a given partial will not go to zero amplitude at the same time in both channels so that beats will occur at different times in the two loudspeakers. The result is analogous to what occurs when making a stereophonic recording of a group of instruments where, because of the different propagation distances from the sound sources to the left and right microphones, the stereophonic ambiance quality is captured.

Figure 4:
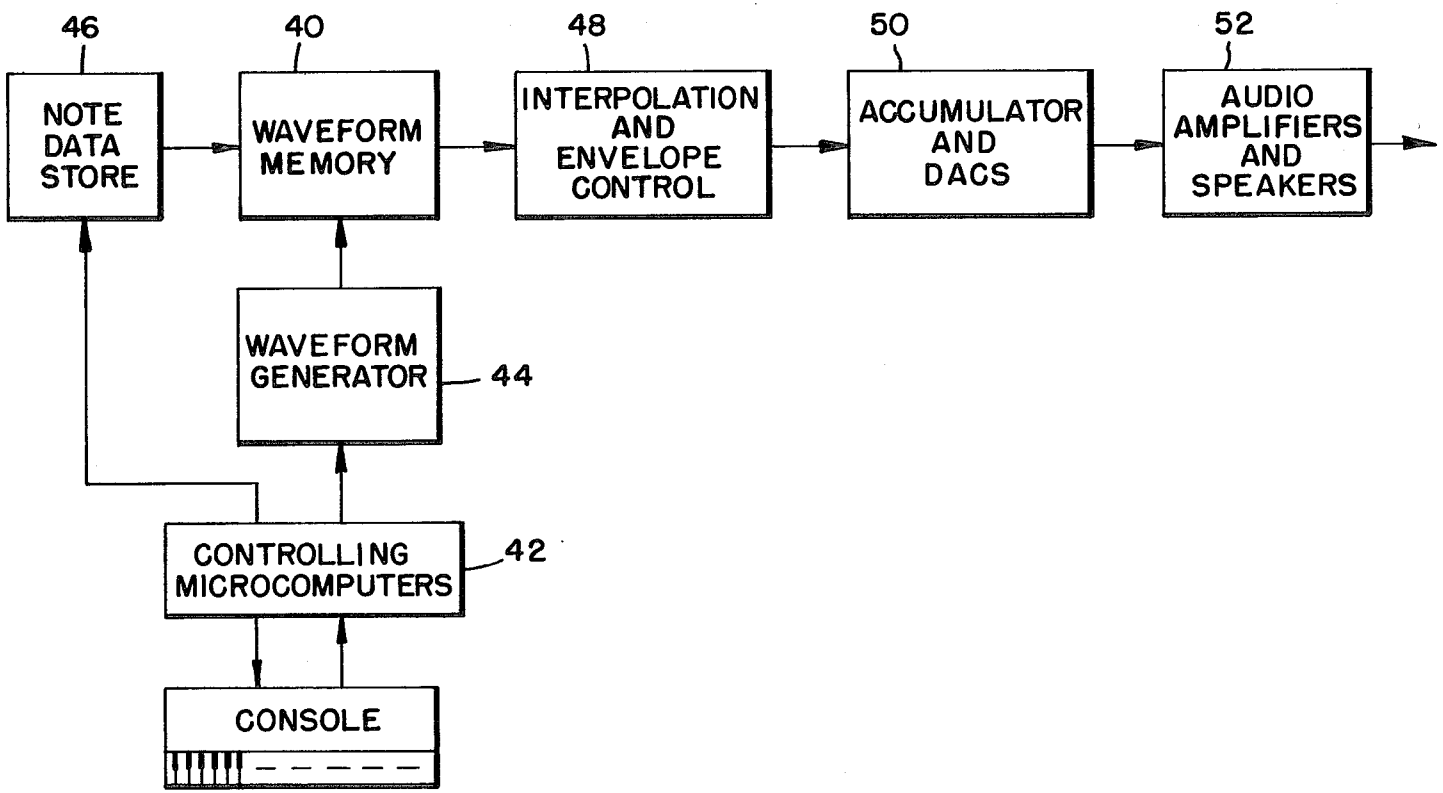
FIG. 4 is a block diagram of an electronic organ suitable for generating two time-displaced notes for each note key.

The generation of complex electrical sound signals which have different time relationships to each other in the two sound reproduction channels is readily accomplished in an electronic organ of the kind utilizing digital waveform readout for producing electronic musical tones, a simplified block diagram of a known organ of this type being shown in FIG. 4 and described in detail in an article by P. J. Comerford entitled, "Bradford Musical Instrument Simulator" published July 1981 in IEE proceedings, Vol. 128, Pt.A, No. 5. Single cycles of waveforms to be used for the simulation of musical notes are generated and stored in read/write waveform memory 40 as tables of signed 12-bit numbers, each table containing $n^2$ numbers representing the values of a like number of equally spaced ordinates of the associated waveform cycle; typically the number of samples is 256. On output, the contents of selected tables are sampled repetitively to produce continuous multicycle waveforms. The only permanently stored waveform is a 512-point single-cycle sinewave, all other waveform information being held in the form of tables of precisely specified harmonic amplitude values in the memory of a master computer 42. A waveform generator 44 works in conjunction with the master computer 42 to rapidly convert these harmonic amplitude tables into single-cycle waveform tables for loading into waveform memory. The contents of waveform memory 40 at any time represent currently selected combinations of organ stops and currently selected instruments only. They are changed, if necessary, when the player changes his selection of stops or instruments.

Waveforms are output by repetitively sampling the contents of waveform stores using pitch counters as address source. To output a particular waveform, a 24-bit pitch counter is allocated to a waveform store or, for waveform interpolation purposes, to a pair of stores, and a pitch count increment value is chosen. this value is added to the count at prescribed intervals and determines the cycle time of the counter. Sampling of the stored waveforms also occurs at the same interval, points on the waveforms being read once or more per cycle or being skipped, according to the size of the count increment. The cycle time of the output waveform is the same as that of the counter. Each 24-bit pitch counter represents an independent note generator, the system having 128 of these generators. Counters, together with registers for storing pitch count increments, are located in a note data store 46, which is built from high-speed random-access memory. Every counter is incremented regularly at the aforementioned prescribed interval under the control of associated circuitry and the increment register contents are changed by the controlling microcomputers 42 whenever frequency changes are required. Also held in the note data store 46 and loaded by the controlling microcomputer are waveform store numbers and waveform amplitude values associated with each note generator. To meet the requirements of waveform interpolation, a pair of waveform store numbers and a pair of amplitude values are specified per note generator. Waveforms are multiplied by their associated amplitude values in an envelope control multiplier 48, a special circuit insuring that changes in amplitude value and waveform store number can only be made at the beginning of waveform cycles; that is, there is always a zero-crossing at the beginning of a waveform cycle and changes made at this point cause minimum waveform discontinuity. As will be seen, it is this feature that enables generation of two identical output signals for each note which are randomly time-displaced from each other.

The envelope control multiplier is followed by an accumulator 50 which adds together the waveforms from the note generators to produce composite waveforms for transmission to the audio output channels 52. Associated with each output channel are two digital-to-analog converters, one used for data conversion and the other for gain control.

When a given key on the console 54 is played, say middle C, the computer determines the pitch increment size for that key and generates a note of the proper pitch for that key. Now if another key is played, the computer sends the value of that key to another phase accumulator to point to the same waveform table. By means of multiplexing, the single-cycle permanently stored waveform can be simultaneously sampled so as to generate a multiplicity of different tones simultaneously, a total of 128 being possible with the Bradford simulator. Thus, there are 128 independent note generators or "oscillators" and the architecture of the system is such that when a given key is played, two oscillators are assigned to that one key. In other words, if the middle C key is depressed, the computer assigns two of the available 128 digital oscillators the task of generating the middle C tone; however, because the two signals are generated by scanning the same stored wave form the resulting tones are time displaced by an imperceptible amount proportional to the multiplexing frequency. This displacement is insufficient to achieve the results described above, but, as was noted earlier, there is always a zero-crossing at the beginning of a waveform cycle and this, coupled with the fact that the accumulators 50 are always running, the tones generated by the assigned digital oscillator can be and statistically are displaced in time from each other in a random fashion. More specifically, all of the oscillators are always running and continue to produce an output at the pitch to which it was last assigned by the depression of a key, except that the output is not heard because the computer instructed the gain for that pitch to go to zero when the depressed key was released. Thus, when a given oscillator is called upon by depression of another note key it will likely be at some point into its pitch incrementing cycle, and since the note will begin to sound only at the beginning of the stored waveform cycle, there will be a slight delay in the start of the tone signal. Considering the number of available generators and the different notes that were last played on each, which can accomplish many different pitches, it is unpredictable where any given oscillator is in the waveform table and the time that will elapse before the beginning of a waveform cycle is reached before it generates a new pitch. Thus, the two oscillators assigned to a depressed key, say middle C, may have last previously been used to generate notes F and G, respectively, and therefore statistically will be "looking" at different places in the waveform table and will therefore arrive at the beginning of the cycle at different times, with the consequence that the two middle C notes generated in response to depression of the middle C key will start at different times. Statistically, they could start at the same time, but chances are that most of the time they will start at different times, with the amount of time displacement random and unpredictable. Thus, as depicted in FIG. 3, in generator 30 the tone from oscillator #1 may start ahead of the tone generated by oscillator #2, or as shown in the waveforms for generator 32, the tone generated by oscillator #2 may start ahead of the tone generated by oscillator #1. The fact that two oscillators, in response to depression of a single key, produce signals of essentially the same harmonic structure but which start at different times, is the basis for generation of the stereophonic effect.

Moreover, the use of two oscillators to produce signals of essentially the same harmonic structure but which start at different times enhances the realism of the organ by limiting the amplitude of the sum signal that results from the electrical combination of two equal amplitude signals to something less than twice the amplitude of the individual signals. By way of example, if it is assumed that a given note is simultaneously played in each of two stops, say, strings and reed, because of the displacement between the starting times of the string voice waveform and the reed voice waveform, when electrically added in one of the two channels will have a combined amplitude dependent on their time displacement. That is, if the waveform of the two voices happen to be in phase, the sum voltage will be double that of an individual signal; if they have a relative phase displacement of 90° the sum amplitude will be larger than the amplitude of one signal but less than twice; and, if they should be displaced in phase by 180° they will cancel. Again, because the tones start at different times, the waveforms of the two voices may be phased differently in the second channel than in the first and thus will add differently with a different total resulting energy. In addition to providing an energy buildup similar to that which occurs with a real pipe organ, the system causes the various organ voices to appear to come from distinct and separate sources.

Besides providing a stereophonic sound image and a pleasant chorus effect, a very important advantage of the invention is the significant reduction in the cost of the amplification/speaker equipment and the space in the console required to house it, because the described effect can be obtained with only two sound reproducing channels. Heretofore, it has been necessary to employ up to six audio channels in electronic organs to obtain good organ sounds having some warmth.

Although one technique for generating substantially identical time-displaced tone signals has been described, it is to be understood that this is by way of example only and that the advantages of the invention can be achieved with alternative forms of tone generators. It is also within the contemplation of the invention to incorporate within a digital tone generating system of the kind described or variations thereof means for predicting and/or controlling the amount of time displacement between the tones generated by two oscillators assigned to the same key.

I claim:

1. An electronic organ system for producing a stereophonic sound image comprising:

tone generating means for producing for each note in a musical range extending throughout several octaves two electrical tone signals which have substantially the same harmonic structure and both having a frequency corresponding to the frequency of the said each note and which are time-displaced relative to each other, first and second electrical signal channels each including a respective loudspeaker for converting electrical signals to sound signals, and means for coupling one of the said two signals for said each note to one of said signal channels and means for coupling the other of the said two signals for said each note to the other of said signal channels.

2. An electronic organ system according to claim 1, wherein said means for producing includes means for causing said two tone signals for said each note to be time-displaced with respect to each other in random fashion.

3. An electronic organ system according to claim 1, wherein said means for producing includes means for controlling the time-displacement between said two tone signals for said each note.

4. An electronic organ system for producing a stereophonic sound image comprising:

tone generating means comprising a multiplicity of digital oscillators for generating electrical tone signals corresponding to notes in a musical range extending throughout several octaves, two of said digital oscillators being assignable at random to the organ key corresponding to each note in said musical range for generating for said each note in response to depression of its corresponding key two tone signals both having substantially the same harmonic structure and both having a frequency which substantially corresponds to the frequency of said each note, and means for causing the two digital oscillators assigned to said each note to start at different times following depression of the organ key corresponding to said each note;

a pair of electrical signal channels each including a respective loudspeaker; and means for coupling a first of the two signals for said each note to one of said channels and means for coupling the second of the two signals for said each note to the other of said channels.

5. An electronic organ system according to claim, 4 wherein said means for causing is operative to cause the start times of the two digital oscillators assigned to said each note to vary in random fashion, and wherein said means for coupling includes means for independently adjusting the amplitudes of the first and the second of said two signals.

6. An electronic organ system according to claim 4, wherein said means for causing includes means for controlling the difference between the start times of the two digital oscillators assigned to said each note, and wherein said means for coupling includes means for independently adjusting the amplitudes of the first and the second of said two signals.

7. An electronic organ system for producing a stereophonic sound image comprising:

tone generating means comprising a multiplicity of digital oscillators for generating electrical tone signals corresponding to notes in a musical range extending throughout several octaves, two of said digital oscillators being assignable at random to the organ key corresponding to each note in said musical range for generating for said each note responsively to depression of its corresponding key two tone signals having substantially the same frequency and which corresponds to the frequency of said each note and having waveforms representing respective different organ voices, and means for causing the two digital oscillators assigned to said each note to start at different times following depression of the organ key corresponding to said each note;

a pair of electrical signal channels each including a respective loudspeaker; and means for coupling a first of the two signals for said each note to one of said channels and means for the coupling the second of the two signals for said each note to the other of said channels, said means for coupling including means for independently adjusting the amplitudes of the first and the second of said two signals.

8. An electronic organ system according to claim 7, wherein said means for causing is operative to cause the start times of the two digital oscillators assigned to said each note to vary in random fashion.

9. An electronic organ system according to claim 7, wherein said means for causing includes means for controlling the difference between the start times of the two digital oscillators assigned to said each note.

* * * * *